US006582521B2

(12) United States Patent
Bertellotti et al.

(10) Patent No.: US 6,582,521 B2
(45) Date of Patent: Jun. 24, 2003

(54) ANNULAR FLOW ELECTROSTATIC POWDER COATER

(75) Inventors: Christopher P. Bertellotti, New Britian, CT (US); Joseph Rogari, Trumbull, CT (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/223,386

(22) Filed: Aug. 19, 2002

(65) Prior Publication Data

US 2003/0059529 A1 Mar. 27, 2003

Related U.S. Application Data

(60) Continuation of application No. 09/802,622, filed on Mar. 9, 2001, now Pat. No. 6,458,427, which is a division of application No. 09/196,677, filed on Nov. 20, 1998, now Pat. No. 6,240,873.

(51) Int. Cl.[7] ..... B05C 5/02; B05C 3/08; B05B 5/00; B05B 5/14; B05D 1/22

(52) U.S. Cl. ..... 118/621; 118/640; 118/629; 118/405; 118/428; 427/459; 427/482; 427/185

(58) Field of Search ..... 118/50.1, 620, 118/621, 640, 405, 467, 420, 309, 629, 630, 633, 644, DIG. 5; 427/32, 454, 27, 460, 475, 477, 487, 485, 486, 185

(56) References Cited

U.S. PATENT DOCUMENTS

| | | | | |
|---|---|---|---|---|
| 3,598,626 | A | 8/1971 | Probst et al. | 118/308 |
| 3,913,523 | A | 10/1975 | Probst et al. | |
| 4,606,928 | A | 8/1986 | Dunford et al. | 427/32 |
| 4,808,432 | A | 2/1989 | Hajek | 427/32 |
| 5,415,113 | A | 5/1995 | Wheeler et al. | 110/241 |
| 5,773,097 | A | 6/1998 | Rogari | 427/459 |

*Primary Examiner*—J. A. Lorengo
(74) *Attorney, Agent, or Firm*—Wood, Herron & Evans, L.L.P.

(57) ABSTRACT

An electrostatic powder coating apparatus including a housing with an interior coating area for receiving a workpiece. The interior coating area includes a vortex inducing surface and a pressurized air input device directs air against the surface to form a swirling pattern of air around the workpiece. A powder introducer directs charged powder into the swirling pattern of air and the powder is then electrostatically attracted to the workpiece. The powder introducer may be a powder fluidizing bed disposed in the housing or other suppliers, such as electrostatic powder spray guns. In alternative embodiments, vortex generators in the form of tubular structures connected proximate the housing inlet and outlet have tangential ports for introducing positive pressure air or inducing vacuum in the tubular structures. These also form a swirling pattern of air which may be used to produce or augment the swirling pattern in the coating area or used to collect excess powder while augmenting the coating at the inlet and outlet.

6 Claims, 4 Drawing Sheets

ANNULAR FLOW ELECTROSTATIC POWDER COATER

This application is a continuation of application Ser. No. 09/802,622, filed Mar. 9, 2001 now U.S. Pat. No. 6,458,427, which is a divisional of application Ser. No. 09/196,677, filed Nov. 20, 1998 (now U.S. Pat. No. 6,240,873), the disclosures of which are fully incorporated herein by reference.

FIELD OF THE INVENTION

The present invention generally relates to powder coating systems and, more particularly, to systems that induce a swirling flow of air and electrostatically charged powder about a workpiece.

BACKGROUND OF THE INVENTION

Powder coating technology has generally evolved over several years into various types of coating techniques. Certain advanced techniques involve the use of electrostatic technology to adhere a powder, such as a resinous polymer or paint, to a desired workpiece preferably with a uniform thickness. The initial adherence of the powder to the surface of the workpiece takes place due to the attraction created by different electric charges existing on the workpiece and the particles of powder. After the initial electrostatic powder coating is formed, the coating is cured using techniques such as heat, infrared light or ultraviolet light, to fully adhere the coating to the workpiece.

Conventional electrostatic techniques for initially adhering the powder particles to a workpiece include two general types. The first type involves electrostatically charging the powder particles emanating in a cloud from a fluidized powder bed. When an electrically conductive, grounded workpiece is placed within the emanating cloud of electrostatically charged particles, the charged particles become attracted to the outer surfaces of the workpiece and form the initial layer of coating. The workpiece may be manually placed within a powder coating hood containing the electrostatically charged powder cloud or may be on a conveyor system or otherwise moved continuously through the hood or other powder coating area. The second powder coating technique utilizes a spray gun discharging electrostatically charged powder particles. An electrode at the gun nozzle may electrostatically charge the particles or the gun may emit a stream of powder particles charged by air upstream of the gun nozzle. With electrostatic guns, the workpieces are again grounded and typically placed within a spray coating hood during a coating operation to contain and collect excess sprayed powder.

A significant, continuing problem associated with electrostatically coating workpieces concerns achieving a uniform coating on the workpiece. With a workpiece oriented or moving horizontally, for example, this problem particularly exists with respect to top to bottom uniformity. That is, the lower surfaces of the workpiece tend to develop a heavier coating build than the upper surfaces. It is believed that this effect may be attributed to stratification, or a progressive decrease in density of particle distribution upwardly over the bed. Also, the charge on the particles may reduce in strength with increased remoteness from the voltage source and/or due to dissipation of the initial charge.

Various solutions have had different amounts of success in dealing with these problems. Some apparatus deal with these problems by creating a swirling or vortex-like flow of air and powder about the workpiece to more evenly distribute the powder particles on all outer surfaces of the workpiece. For example, U.S. Pat. Nos. 4,606,928; 4,808,432; and 5,773,097, each assigned to the assignee of the present invention, are all concerned with apparatus that distribute charged powder particles more uniformly about a workpiece, such as a continuous elongate strand of wire, cable, tubing or other like material. While devices such as these have met with significant success, it would still be desirable to provide improvements relative to achieving cost efficiencies, size reduction and reduced overall complexity of the devices as well as continued improvement in coating uniformity.

SUMMARY OF THE INVENTION

The present invention generally provides powder coating apparatus including a housing having a coating area positioned generally between first and second end walls with the first end wall having an inlet for receiving a workpiece and the second end wall having an outlet for allowing the workpiece to exit the coating area. A workpiece travel path extends between the inlet and the outlet and, for example, may generally define the travel path of an elongate wire, strand or other continuous or discrete workpieces moving along the travel path. In accordance with the invention, the coating area includes a surface extending lengthwise along the direction of the workpiece travel path and sloping transversely at least partially around the workpiece travel path. This transverse, sloped surface may be on an outer wall of the housing or may be a sloped interior wall or baffle structure in a conventional box-like housing or any other interior sloped surface achieving the effects of this invention. The surface is preferably sloped in at least two directions to promote an annular swirling air pattern as will be described below and is more preferably a continuously curving wall surface, such as a cylindrically-shaped wall surface. An air moving device is positioned to move air adjacent this surface to produce the swirling air pattern about the workpiece. In the preferred embodiment, the air moving device introduces pressurized air against the surface and lengthwise along the workpiece travel path. This surface may be referred to as a vortex inducing surface because the air follows the surface and generally flows in an annular swirling pattern around at least a portion of the workpiece travel path. A powder introducer is operatively connected with the coating area of the housing and introduces powder into the annular swirling pattern of air to coat the workpiece. It is contemplated that the air moving device could be a vacuum producing device and it is preferred that the powder introducer directs electrostatically charged powder into the swirling air pattern.

The pressurized air input device most preferably comprises a tube extending along the length of the vortex inducing surface and having a plurality of apertures or, for example, one or more slots for directing air into the swirling pattern. As one illustrative alternative, the pressurized air input device may instead comprise a plurality of separate air inputs, such as nozzles, mounted adjacent the vortex inducing surface. The charged powder introducer preferably includes a powder fluidizing bed communicating with the coating area and adapted to receive a supply of ionized or charged air to form a cloud of charged powder. A powder feed hopper may be provided to supply powder to the fluidizing bed. In this preferred embodiment, the annular swirling pattern of air also swirls the charged powder cloud generally around and into the workpiece travel path. As one illustrative alternative, the charged powder introducer may include a charged powder supplier, such as a triboelectric powder spray gun, connected with the pressurized air input device for supplying charged powder directly into the swirling pattern. In another alternative, a spray gun or other charged powder introducer may be otherwise connected with the coating area.

In another aspect of the invention, a pair of vacuum chambers may be connected proximate the inlet and outlet of the housing to prevent powder from exiting the housing. More specifically, one or both chambers may be connected to a source of vacuum in a manner that draws air and powder out of the respective chambers in a swirling pattern. When used in conjunction with the vortex inducing system associated with the coating area or another vortex system, the air and powder flow pattern in the vacuum chamber or chambers preferably swirls in the same direction as the swirling pattern in the coating area.

From the foregoing description, it will be recognized that a cost efficient, relatively simplified apparatus has been provided for inducing a swirling or vortex-type of charged powder and air flow around a workpiece for effecting uniform electrostatic powder coating. The use of inlet and outlet vacuum chambers also inducing a swirling pattern of powder and air further promotes a uniform coating.

Other embodiments of the invention also generally comprise a housing having a coating area for receiving a workpiece or workpieces and a workpiece travel path extending between an inlet and outlet thereof. In these alternative embodiments, first and second vortex generators are mounted around the inlet and the outlet and comprise inner and outer tubular structures each connected with a pressurized air inlet. The pressurized air inlet communicates with at least one annular space formed between the inner and outer tubular structures and the annular space opens around the workpiece travel path within the coating area. The air inlets are configured to introduce pressurized air in an annular swirling pattern within the annular space and out around the workpiece travel path. This may be accomplished using a generally tangential air inlet connection. As in the first embodiment, these embodiments will include a powder introducer operatively connected with the coating area of the housing for introducing powder into the swirling pattern of air.

In one alternative embodiment, the tubular vortex generators are connected to the outside of the housing and coating area while, in another alternative embodiment, the tubular vortex generators are connected within the housing and the coating area. It is contemplated that other modifications, such as partially mounting the vortex generators both inside and outside of the housing, or eliminating the inner tubular structure, may be used as well. As in the first embodiment, the charged powder introducer may comprise a powder fluidizing bed that produces a cloud of charged powder directed into the swirling pattern of air or a charged powder supplier, such as a triboelectric powder spray gun, operatively connected with the coating area. For example, the spray gun may be connected to one or both of the air inlets communicating with the annular spaces.

As further alternatives utilizing concepts in accordance with the invention, the inner tubular structures may be eliminated from the embodiments discussed above, and positive pressurized air may be introduced into a single tubular structure in a generally tangential manner to introduce a generally annular swirling flow within the tubular structure such that it becomes directed into the main coating area of the housing around the workpiece travel path. This may be used as the main vortex generator of the coater or may augment another vortex generator in the coater, such as the one described in connection with the first embodiment. As another alternative, the inner and outer tubular structures discussed above may instead have their annular space connected with a source of vacuum to act as powder collectors proximate the inlet and outlet of the coating area. In this option, a swirling vacuum effect is created in the annular spaces of the tubular structures preferably in the same direction as the main annular swirling flow in the coating area. The main annular swirling flow may be formed, for example, in accordance with the first embodiment.

The present invention further contemplates various electrostatic powder coating methods that may be carried out in accordance with the general teachings of the inventive concepts discussed herein. Additional objects, advantages and features of the invention will become more readily apparent to those of ordinary skill in the art upon reviewing the following detailed description of the preferred embodiments taken in conjunction with the accompanying drawings.

DETAILED DESCRIPTION OF THE PREFERRED EMBODIMENTS

Figure 1:
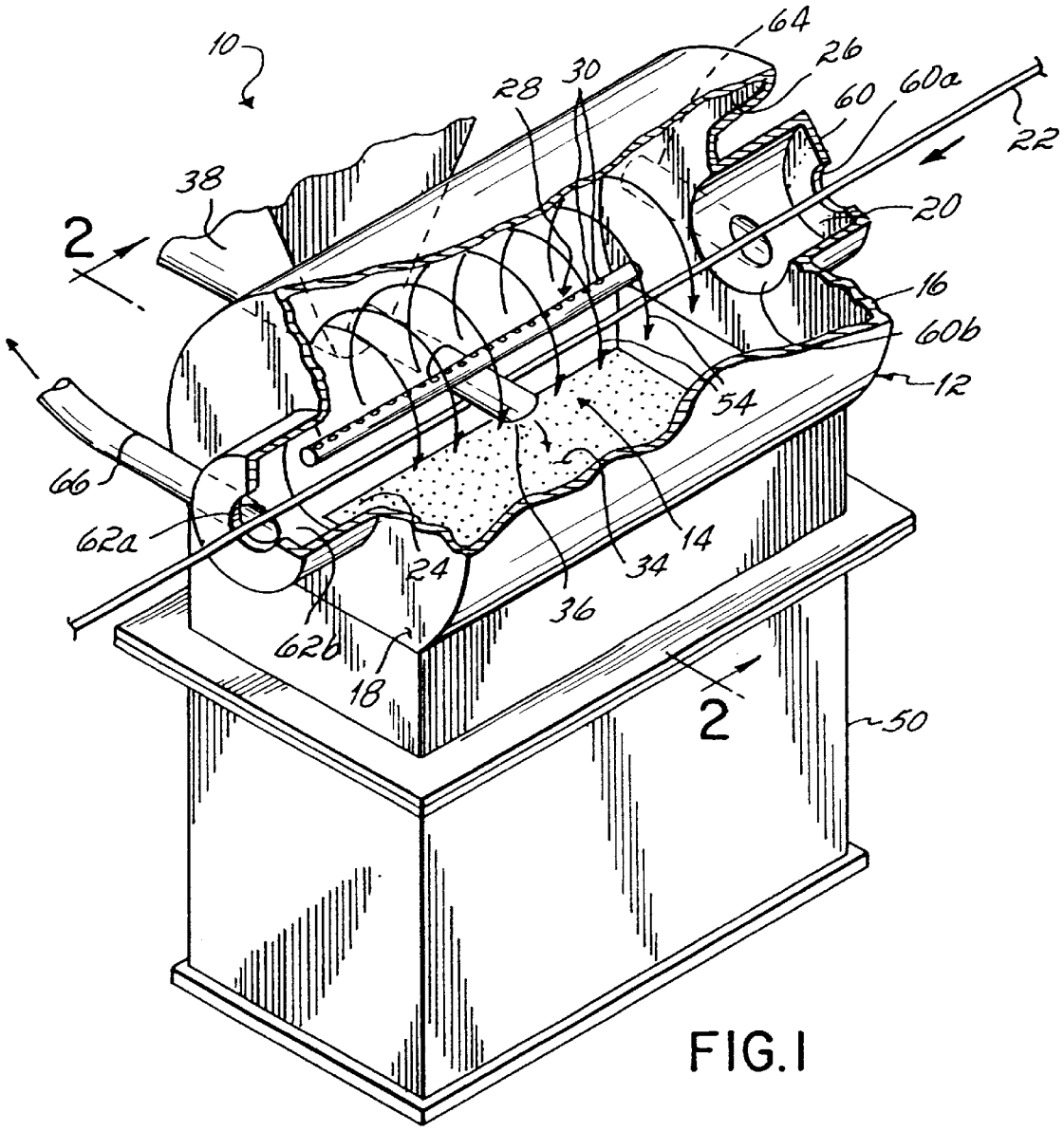
FIG. 1 is a perspective view of an electrostatic powder coating apparatus constructed in accordance with one embodiment of the invention.
Figure 2:
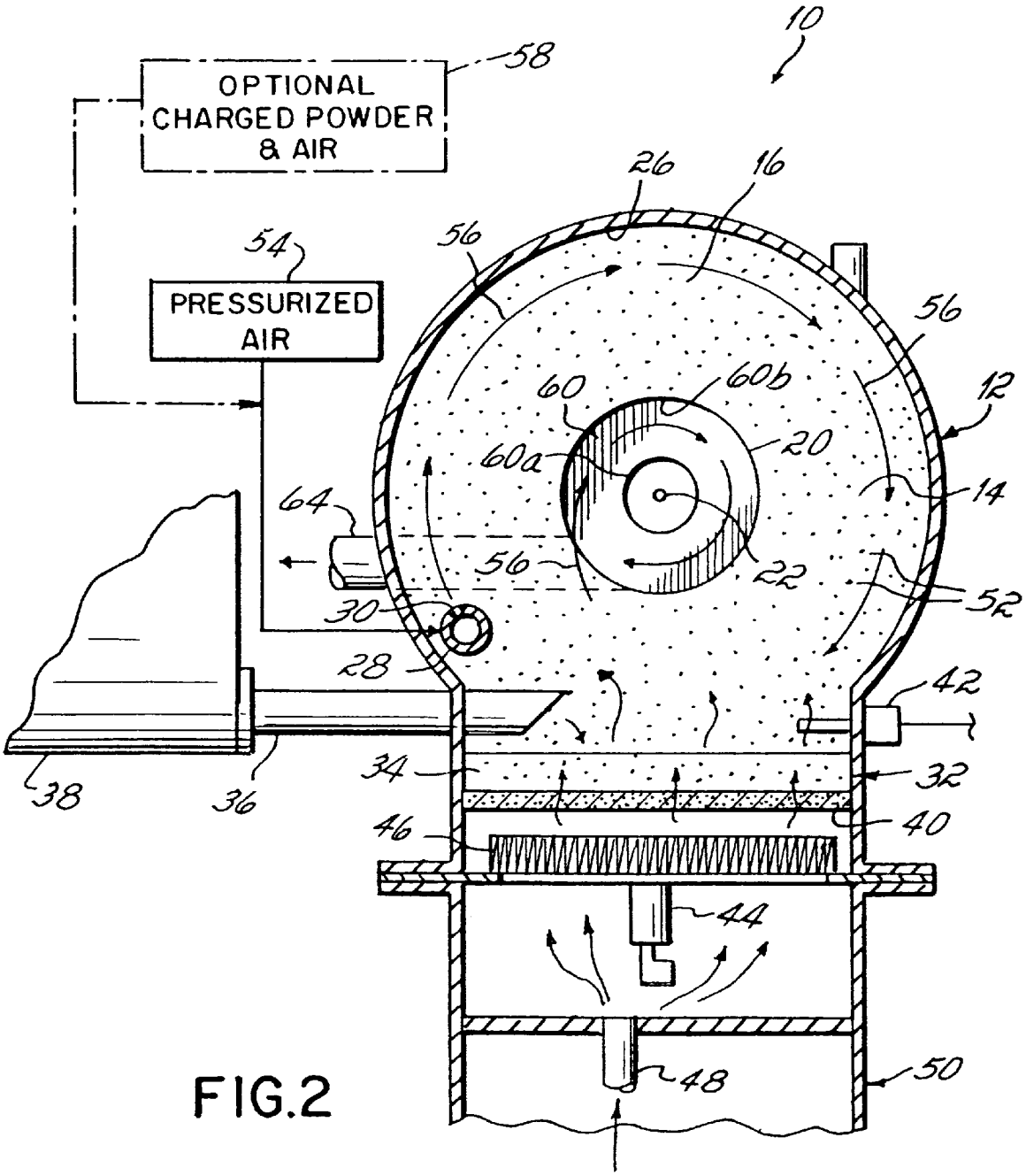
FIG. 2 is a cross sectional view taken generally along line 2—2 of FIG. 1 and schematically illustrating a pressurized air input and an optional charged powder and air input.

Referring to FIGS. 1 and 2, an electrostatic powder coating apparatus 10 is shown constructed in accordance with a preferred embodiment. Apparatus 10 includes a housing 12 having an interior coating area 14 positioned generally between first and second end walls 16, 18. End wall 16 includes an inlet 20 for receiving a workpiece 22 and end wall 18 includes an outlet 24 through which workpiece 22 moves after electrostatic coating has taken place. Apparatus 10 is particularly suited to coat elongate workpieces, such as cable, wire, tubing and the like, however, individual workpieces may be coated as well.

Coating area 14 generally includes a curved interior wall surface 26 extending around workpiece 22. As will be appreciated from the description to follow, this surface 26 generally needs to be sloped in order to induce a vortex or swirling-type of air flow pattern. Surface 26 is preferably curved continuously in a cylindrical fashion as best shown in FIG. 2. However, it is contemplated that multiple, sloped surfaces which are either flat or curved may be substituted to create the same general flow pattern. Coating area 14 further includes an air input device, preferably in the form of a tube 28. Tube 28 extends along a lower lengthwise portion of surface 26 and includes a plurality of apertures 30 for directing pressurized air such that it follows the curved wall surface 26 into a swirling pattern, as will be discussed below. Preferably, the air is directed into tube 28 at about 40–60 psi and apertures 30 are about ¼" in diameter. In the preferred embodiment, coating area 14 may be less than one foot long and even smaller in width. This relatively small size intensifies the charge and density of the powder cloud in coating area 14. Also, the placement of tube 28 adjacent wall 26 helps force air and powder to swirl toward workpiece 22 for more effective coating.

A powder fluidizing bed 32 is used to fluidize and charge a bed 34 of powder. A feed tube 36 extending from a feed hopper 38 preferably supplies powder to bed 34. In a known manner, feed tube 36 may include a rotating auger (not shown) for this purpose. Powder fluidizing bed 32 further includes a porous plate 40 and may include a powder level sensor 42 operatively connected to rotate the auger inside feed tube 36 in a known manner. A voltage source, in the form of a charging electrode 44 and a brush assembly 46, as well as a pressurized air inlet 48, are mounted within a base 50 of apparatus 10. In a generally conventional manner, pressurized air is introduced through inlet 48 such that it contacts the electrostatically charged bristles of brush 46 and flows through porous plate 40 to fluidize and, at the same time, electrostatically charge the powder in bed 34. Some of this powder becomes an airborne cloud of charged powder 52 as shown in FIG. 2.

A source 54 of pressurized air communicates with air input tube 28 during operation of apparatus 10 to introduce a swirled pattern of moving air within coating area 14. This air moves through the plurality of apertures 30 in tube 28 and generally along surface 26. The air thereby swirls in the direction of arrows 56 around workpiece 22. This swirling or vortex-type of air and powder flow within coating area 14 ensures that powder is uniformly distributed about the peripheral surfaces of workpiece 22. It also tends to move the powder 52 toward workpiece 22 for faster, more effective coating. As one option, a charged powder and air supply 58 may be connected to tube 28. This may, for example, comprise a conventional triboelectric powder spray coating gun that discharges electrostatically charged powder particles in a stream of pressurized air. Of course, other alternative types of charged powder introducers may be used as well. Charged powder input devices may communicate with coating area 14 for introducing charged powder particles into a swirling air pattern formed through the interaction of an air input device, such as tube 28, and an internal sloped wall surface, such as wall surface 26.

Inlet and outlet chambers 60, 62 are connected proximate the respective inlet and outlets 20, 24 of end walls 16, 18. An opening 60*a* and an opening 62*a* define the actual inlet and outlet to housing 12 when this feature is incorporated as shown. As another aspect of this invention, a pair of vacuum tubes 64, 66 are respectively connected to inlet and outlet chambers 60, 62 in a generally tangential manner. Thus, vacuum draws air and powder out of chambers 60, 62 in a swirling pattern of the same direction as the swirling pattern formed in coating area 14. For this purpose, inlet and outlet chambers 60, 62 also have vortex inducing internal wall surfaces 60*b,* 62*b,* preferably shaped in a curved manner such as a cylindrical manner, to induce a swirling air and powder flow pattern within each chamber 60, 62. This promotes further uniform coating of workpiece 22 with chambers 60, 62. It will be appreciated that internal wall surfaces 60*b,* 62*b* may be substituted with other appropriately sloped surfaces on the walls themselves or on other inserts or internal structure for inducing this type of swirling flow pattern.

Figure 3:
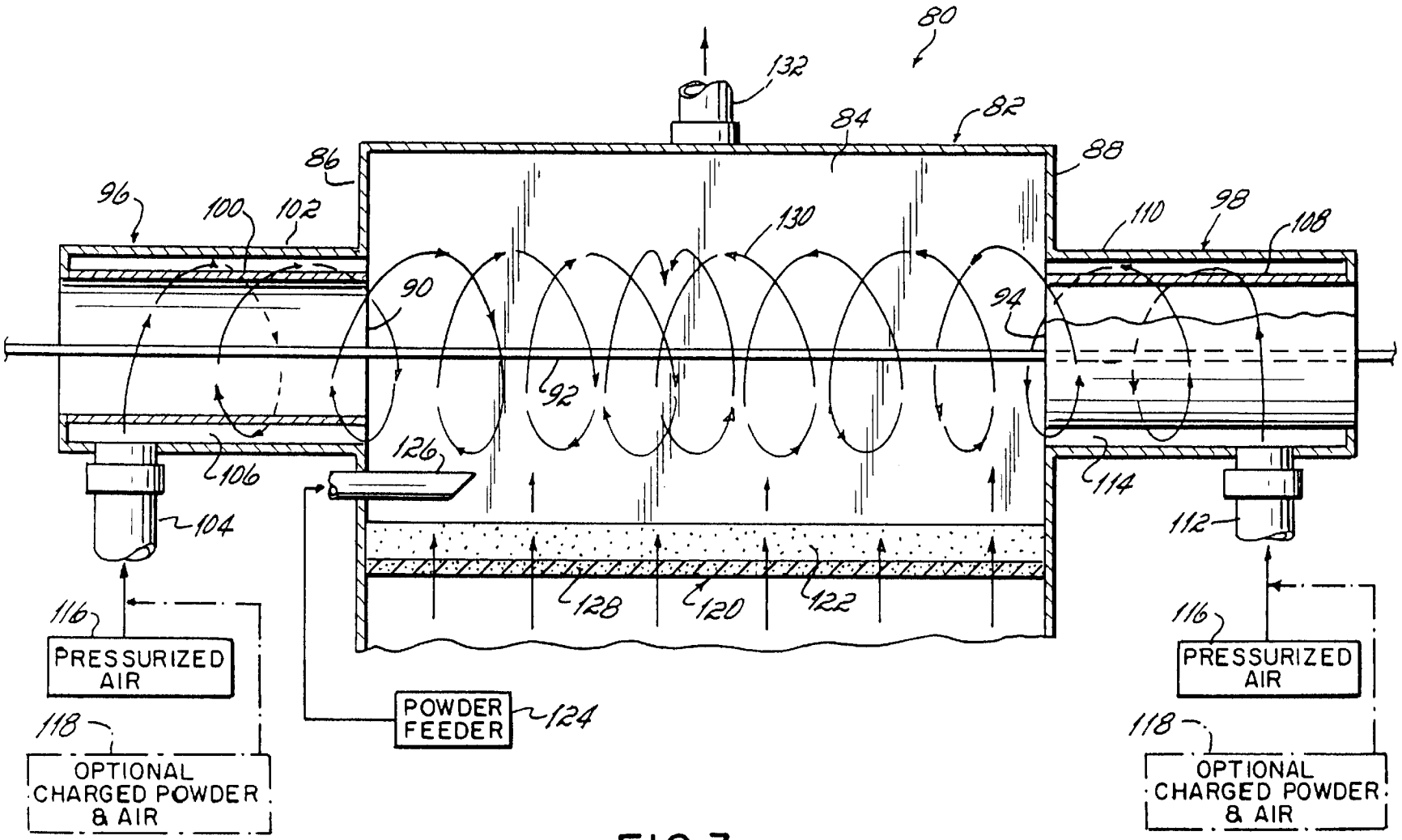
FIG. 3 is a longitudinal cross section of an electrostatic powder coating apparatus constructed in accordance with one alternative embodiment.

FIG. 3 illustrates one alternative embodiment for developing a swirling pattern of air and electrostatically charged powder. Specifically, an apparatus 80 includes a housing 82 with an interior coating area 84 positioned generally between end walls 86, 88. Coating area 84 includes an inlet 90 generally located at end wall 86 for receiving a workpiece 92, and an outlet 94 generally located at end wall 88. Respective vortex generators 96, 98 are connected proximate inlet and outlet 90, 94. More specifically, vortex generator 96 comprises an inner tube 100 mounted within an outer tube 102 and including a pressurized air inlet 104 communicating with an annular space 106 therebetween. Likewise, vortex generator 98 comprises an inner tube 108 mounted within an outer tube 110 and including a pressurized air inlet 112 communicating with an annular space 114 therebetween. One or more pressurized air supplies 116 direct pressurized air into inlets 104, 112.

In this embodiment, a powder fluidizing bed 120 is provided to form an electrostatic cloud of powder emanating from a bed 122. As discussed with respect to the first embodiment, one or more charged powder and air supplies 118 may be connected to inlets 104, 112 or otherwise connected to supply charged powder to coating area 84. As with the first embodiment, a powder feeder 124 may supply powder to bed 120 via a supply conduit or tube 126. Also as described above, pressurized, charged air is directed through a porous plate 128 to fluidize powder bed 120 and direct charged powder upwardly into the swirling pattern of air schematically represented by arrows 130. A vacuum conduit 132 communicates with coating area 84 to draw excess air and powder out of housing 82 during a coating operation.

Figure 4:
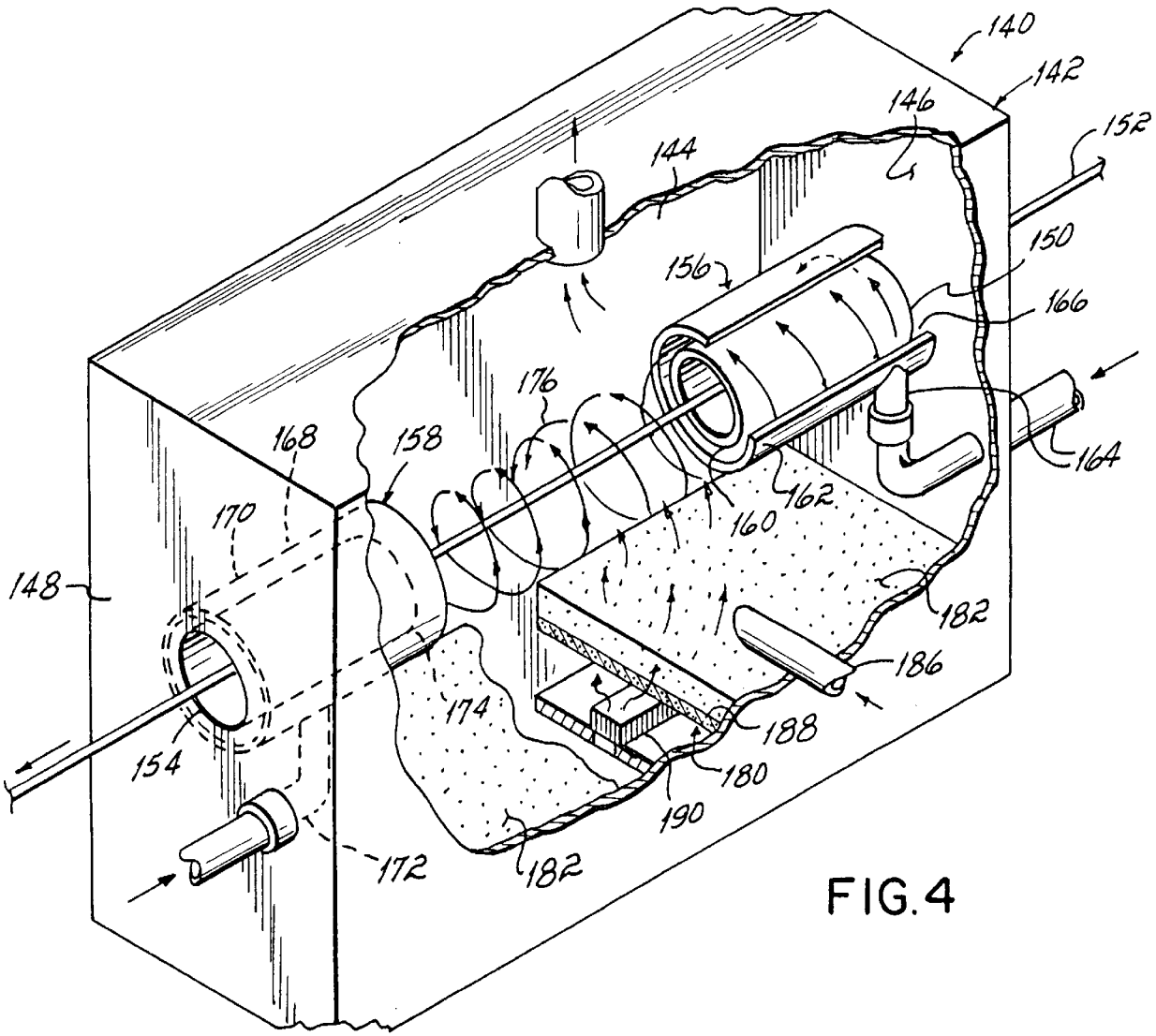
FIG. 4 is a perspective view of another alternative embodiment with portions of the housing broken away to show inner details.

Another embodiment of the invention is shown in FIG. 4 as an electrostatic coating apparatus 140 similar to the embodiment shown in FIG. 3. Apparatus 140 comprises a housing 142 having an interior coating area 144 positioned between end walls 146, 148. End wall 146 includes an inlet 150 for receiving a workpiece 152, such as a continuous strand or wire substrate. An outlet 154 is provided in end wall 148. Respective vortex generators 156, 158 are connected proximate inlet and outlet 150, 154. Specifically, vortex generator 156 comprises inner and outer tubes 160, 162 mounted around inlet 150. A pressurized air inlet 164 communicates with an annular space 166 between inner and outer tubes 160, 162. Pressurized air inlet 164 is preferably connected in a generally tangential manner to outer tube 162 to promote an annular or swirling type of flow pattern within space 166. Likewise, vortex generator 158 at outlet 154 comprises inner and outer concentric tubes 168, 170 mounted around outlet 154. A pressurized air inlet 172 communicates with an annular space 174 located between inner and outer tubes 168, 170 and is again connected in a manner which induces a generally circular or swirling flow pattern around annular space 174. Preferably, this circular flow pattern is induced in the same direction within each vortex generator 156, 158 and exits vortex generators 156, 158 within coating area 144 while continuing to move in a generally swirling path as indicated schematically by arrows 176.

Preferably, a powder fluidizing bed 180 is provided for producing a cloud of electrostatically charged powder which then follows the swirling flow path 176 and swirls around workpiece 152 while generally being drawn or electrostatically attracted to workpiece 152 and thereby coating the same. Powder fluidizing bed 180 more specifically comprises a bed of powder 182 that may be continuously or intermittently supplied by a conduit 186 and that is fluidized by pressurized air directed through a porous plate 188 after being ionized or charged by a brush 190. As with the other embodiments of the invention, other direct or indirect manners of introducing charged powder into the air flow pattern 176 may be used as alternatives or in addition to a fluidizing bed.

The embodiment of FIGS. 1 and 2 may be combined with various features of the embodiments shown in FIGS. 3 and 4. Specifically, the vortex generators shown in either FIG. 3 or FIG. 4 may be substituted for vacuum chambers 60, 62 of apparatus 10. Using this option, the vortex generators would be connected to at least one source of vacuum for drawing air into the annular spaces in a swirling annular flow which is preferably in the same direction as the annular flow formed within coating area 14. As one more alternative, inner tubes 100, 108 or 160, 168 may be eliminated and positive pressure air may be introduced into outer tubes 102, 110 and 162, 170 in a generally tangential manner which forces a swirling annular flow of air, optionally combined with powder, into coating area 84 or 144.

While the present invention has been illustrated by a description of various embodiments and while these embodiments have been described in some detail, it is not the intention of the Applicants to restrict or in any way limit the scope of the appended claims to such detail. The various unique aspects of this invention may be utilized alone or in various desirable combinations according to the needs of the application. Additional advantages and modifications will readily appear to those skilled in the art. This has been a description of the present invention, along with the preferred methods of practicing the present invention as currently known. However, the invention itself should only be defined by the appended claims, wherein we claim:

What is claimed is:

1. A powder coating apparatus comprising:

a housing having a powder coating area positioned generally between an inlet for receiving a workpiece and an outlet for allowing the workpiece to exit the powder coating area, the powder coating area having a workpiece travel path extending between the inlet and the outlet, the housing including an interior surface extending lengthwise along the direction of said workpiece travel path and sloped transversely at least partially around said workpiece travel path, and an input device including an outlet communicating with said powder coating area and configured to spray pressurized air and powder in a direction generally following said interior surface.

2. The powder coating apparatus of claim 1, further comprising:

a powder charging device configured to electrostatically charge the powder sprayed into said powder coating area.

3. The powder coating apparatus of claim 1, further comprising:

a second input device including a second outlet communicating with said powder coating area and configured to spray pressurized air and powder in a direction generally following said interior surface such that the air and powder from said second input device swirl around at least a portion of said workpiece travel path.

4. The powder coating apparatus of claim 1, wherein said transversely sloped surface further comprises a curved surface.

5. The powder coating apparatus of claim 1, wherein said transversely sloped surface is at least partially cylindrical.

6. The powder coating apparatus of claim 1, further comprising:

a powder and air supply coupled to said input device.

* * * * *